United States Patent [19]

Doty et al.

[11] 4,384,314

[45] May 17, 1983

[54] CONTROL SYSTEM FOR PLURAL TRANSFORMER RELAYS

[75] Inventors: Charles T. Doty, Troy Township, St. Croix County, Wis.; Douglas R. Mosier, White Bear Lake, Minn.

[73] Assignee: Minnesota Mining and Manufacturing Company, St. Paul, Minn.

[21] Appl. No.: 259,183

[22] Filed: Apr. 30, 1981

[51] Int. Cl.[3] ..... H01H 9/00

[52] U.S. Cl. ..... 361/160; 340/825.98; 361/209

[58] Field of Search ..... 361/191, 160, 209; 340/825.98, 825.18

[56] References Cited

U.S. PATENT DOCUMENTS

| | | | |
|---|---|---|---|
| 3,461,354 | 8/1969 | Bollmeier | 361/209 |
| 3,800,185 | 3/1974 | Anton et al. | 340/41 R |
| 4,321,652 | 3/1982 | Baker et al. | 361/209 |

OTHER PUBLICATIONS

"Switching Tricks", Radio-Electronics, May 1972, pp. 54–56, Matthew Mandl.

*Primary Examiner*—Reinhard J. Eisenzopf

*Attorney, Agent, or Firm*—Cruzan Alexander; Donald M. Sell; William D. Bauer

[57] ABSTRACT

A control system adapted to control a plurality of transformer relays. An electrical isolation network is coupled to each of a plurality of transformer relays, having a pair of common control lines and providing electrical isolation for each of the plurality of transformer relays. A switch is coupled to the electrical isolation network and is coupled in parallel to the plurality of transformer relays providing selection of state of all of the plurality of transformer relays. The electrical isolation network may also provide control, as e.g. unidirectional current flow, for selecting a state of each of the plurality of transformer relays. In a preferred embodiment the electrical isolation network includes an array of diodes.

9 Claims, 4 Drawing Figures

CONTROL SYSTEM FOR PLURAL TRANSFORMER RELAYS

BACKGROUND OF THE INVENTION

The present invention relates generally to control systems for a plurality of transformer relays and more particularly to control systems for a plurality of transformer relays where the secondary windings of the transformer relays are not balanced or where the primary windings of the transformer relays are connected to separate sources of power.

Transformer relays of the type contemplated to be controlled by the control system of the present invention are available in the art. An example in U.S. Pat. No. 3,461,354, Bollmeier, Magnetic Remote Control Switch, issued Aug. 12, 1969, which describes a magnetically stable transformer relay having primary and secondary coils with the secondary coil being connected to a switch and a rectifier for shorting the secondary coil to allow unidirectional current flow in a desired direction. The control system for the transformer relay is the single rectifier coupled in connection with a double pole, double throw switch which allows the rectifier to be momentarily coupled in either direction across the secondary of the transformer relay. The Bollmeier patent discloses a single transformer relay with a single control switch. Another transformer relay with which the control system of the present invention may be utilized is illustrated in U.S. Pat. No. 4,321,652, Baker et al., Low Voltage Transformer Relay, issued Mar. 23, 1982. Baker also discloses a magnetically stable transformer relay having a primary winding and a secondary winding with the unidirectional flow of current in the secondary winding controlling the state of the transformer relay. The control system disclosed in Baker is a single pole, double throw momentary action switch coupled with a pair of diodes, one in each direction, to allow a unidirectional current flow in the secondary winding of the transformer relay in either direction. The control system in Baker discloses a single transformer relay with a plurality of rectifying switches. The transformer relay in both Bollmeier and Baker are magnetically latched to either of two stable states. The control of the state of the transformer relay is provided by the unidirectional flow of current in the secondary winding (coil). A flow in one direction will control the transformer relay to an "on" state (closing a load switch) and a flow of current in the other direction will cause the transformer relay to be controlled to an "off" state (opening a load switch).

A control system for a transformer relay as described in Bollmeier and Baker is described in U.S. Pat. No. 4,338,649, Mosier, A System for Remotely Controlling a Load, issued July 6, 1982. The control systems described in Mosier provide control of a single transformer relay with a plurality of switches or controls.

Many applications, however, require the control of a plurality of transformer relays with one or more switches positioned at one or more switch locations. While transformer relays can be connected with their secondary windings in parallel, to do so creates certain problems. In a large building or industrial complex, the power source supplying the building may be multiphase. In this case, the individual transformer relays may be connected to differing phases of the same power source. This, in effect, means that each transformer relay may be connected to a separate power source. If the secondary windings of these transformer relays are then coupled in parallel, undesirable circulating currents between the secondary windings of the transformer relays will occur. This is because the instantaneous voltage between secondary windings of the transformer relays and the balance between those voltages will vary creating the circulating currents between them. These circulating currents may cause inappropriate uncontrolled operation. Even where the transformer relays are all connected to the same power source, i.e., to the same phase, there can still be problems. Since the transformer relays are not exactly matched or balanced, the exact voltage present on the secondary winding of each transformer relay will still vary from transformer relay to transformer relay. Since differing voltages will again occur, currents will again circulate between the secondary windings of the plural transformer relays causing reliability problems.

SUMMARY OF THE INVENTION

A control system is provided which is adapted to control a plurality of transformer relays with each of the plurality of transformer relays having a primary winding capable of being coupled to a separate source of power, having a secondary winding and having a plurality of states controllable from the secondary winding. An electrical isolation means selectively couples a first side of the secondary winding of each of the plurality of transformer relays. The electrical isolation means has a pair of common control lines and provides electrical isolation for each of the plurality of transformer relays and provides the capability for selectively controlling the plurality of transformer relays to an individually predetermined one of the plurality of states. A switching means couples one of the common control lines of the electrical isolation means to a second side of the secondary winding of the plurality of transformer relays. The switching means selects to which of the plurality of states the plurality of transformer relays are controlled. In this manner, each of the plurality of transformer relays can be controlled to a predetermined one of the plurality of states by the switching means with the maintenance of electrical isolation for each transformer relay Where the transformer relays have a pair of states controllable by a unidirectional current flow in the secondary winding, the electrical isolation circuit may consist of an array of diodes with a pair of diodes for each transformer relay. A first side of the secondary winding of an associated transformer relay is coupled to a common connection of a pair of diodes oppositely directed with the opposite ends of the diodes coupled selectively to the common control lines of the electrical isolation circuit. The second side of each of the secondary windings of the transformer relays is connected in parallel and to the common terminal of a switch. The switched terminals of the switch are selectively then coupled to the pair of common control lines.

The present invention solves the problem of circulating currents between secondary windings of the transformer relays by putting an electrical isolation network between the secondary windings and the switch and allows plural transformer relays to be utilized and controlled from a single switch location utilizing a single switch. When the transformer relays are operated by unidirectional flow of current in the secondary winding, then the electrical isolation network can also operate to provide the directional control necessary for the switching element. In this case, the switch then need only be a single pole, double throw switch. Of course, directional diodes could be utilized with the switch without loss of function.

BRIEF DESCRIPTION OF THE DRAWINGS

The foregoing advantages, construction and operation of the present invention will become more readily apparent from the following description and accompanying drawings in which.

DESCRIPTION OF THE PREFERRED EMBODIMENTS

Figure 1:
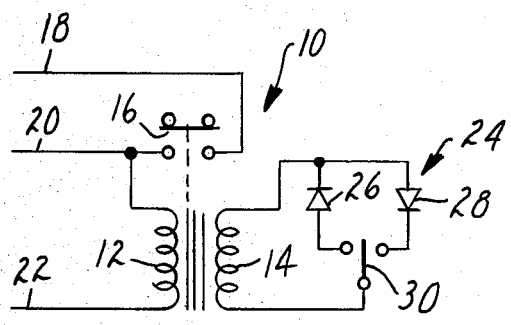
FIG. 1 PRIOR ART
FIG. 1 is a prior art transformer relay operated with a rectifying switch.

FIG. 1 illustrates a typical transformer relay application as described in the Bollmeier patent and in the Baker application. The figure shows a transformer relay 10 having a primary winding 12 and a secondary winding 14. The transformer relay 10 has a load switch 16 which can be connected to a load (not shown) through load lead 18. The primary winding 12 can be connected to a source of power (not shown) through power lead 20 and reference lead 22. The secondary winding 14 is connected to a rectifying switch 24. The rectifying switch 24 contains two diodes 26 and 28 and a single pole, double throw switch 30. The transformer relay 10 is magnetically stable in either of two states, with the load switch 16 either "on" or "off". A unidirectional flow of current in the secondary winding 14 determines to which stable state the transformer relay 10 will be controlled. When the single pole, double throw switch 30 is momentarily thrown to the left, diode 26 will allow a unidirectional flow of current through the secondary winding 14 from top to bottom in the figure while a momentary action of the single pole double throw switch 30 to the right will cause diode 28 to control the current to flow in secondary winding 14 from bottom to top. Note that only two wire control is required from the secondary winding 14 of the transformer relay 10 to the rectifying switch 24. Since the function of a transformer in a transformer relay 10 is utilized, the voltage going to rectifying switch 24 may be lower than the primary source of power connected to power lead 20 and reference lead 22 and thus a low voltage control of load switch 16 is accomplished.

Certain applications require the control of a plurality of loads from one or more locations. If the plural loads cannot be coupled to a single load switch in a single transformer relay due to either power requirements (high current) or due to physical location of the loads, then a plurality of transformer relays are required to control the loads.

Figure 2:
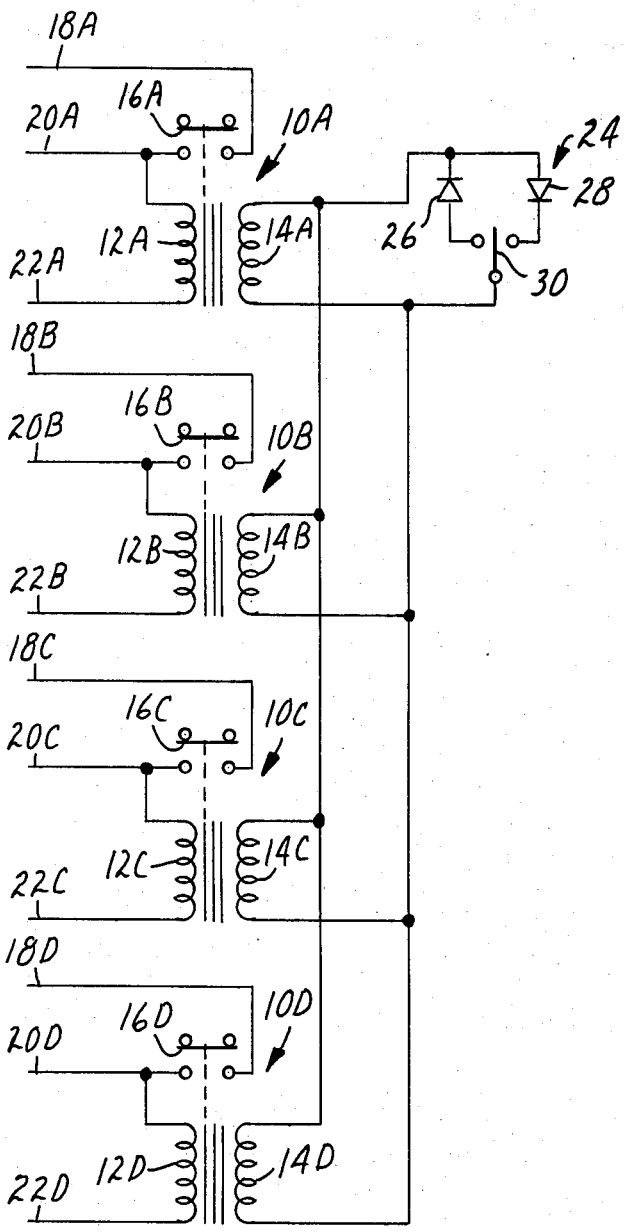
FIG. 2 PRIOR ART
FIG. 2 is a parallel connection of a plurality of transformer relays.

FIG. 2 shows an exemplary connection of a plurality of transformer relays 10A, 10B, 10C and 10D with the secondary windings 14A, 14B, 14C and 14D connected in parallel to provide control of the plural transformer relays 10A, 10B, 10C, and 10D from a single rectifying switch 24. Transformer relay 10A has a primary winding 12A coupled to a power source (not shown) with power lead 20A and reference lead 22A. Load switch 16A is adapted to be connected to a load (not shown) with load lead 18A. Similar connections are provided for transformer relays 10B, 10C, and 10D.

The transformer relays 10A, 10B, 10C, and 10D in FIG. 2 may be connected to the same source of power or may be connected to separate sources of power. The separate sources of power may, for example, be differing phases in a facility supplied with a multiphase power supply such as a large office building or an industrial complex. If the secondary windings 14A, 14B, 14C, and 14D of the transformer relays 10A, 10B, 10C, and 10D, respectively, are not exactly matched, differing voltages will appear at the secondary windings 14A, 14B, 14C, and 14D. Similarly, if primary windings 12A, 12B, 12C, and 12D are connected to differing sources of power, e.g. different phases, instantaneously differing voltages will appear on the secondary windings 14A, 14B, 14C, and 14D. Either of these events will cause circulating currents to occur among the secondary windings 14A, 14B, 14C, and 14D with inappropriate uncontrolled operation and/or attendant heating of the transformer relays 10A, 10B, 10C, and 10D due to the resultant power dissipation. Note that the connection illustrated at FIG. 2 still only requires a two wire connection between transformer relays 10A, 10B, 10C, and 10D, and the rectifying switch 24. Rectifying switch 24, as in FIG. 1, has diodes 26 and 28 and a single pole, double throw switch 30.

Figure 3:
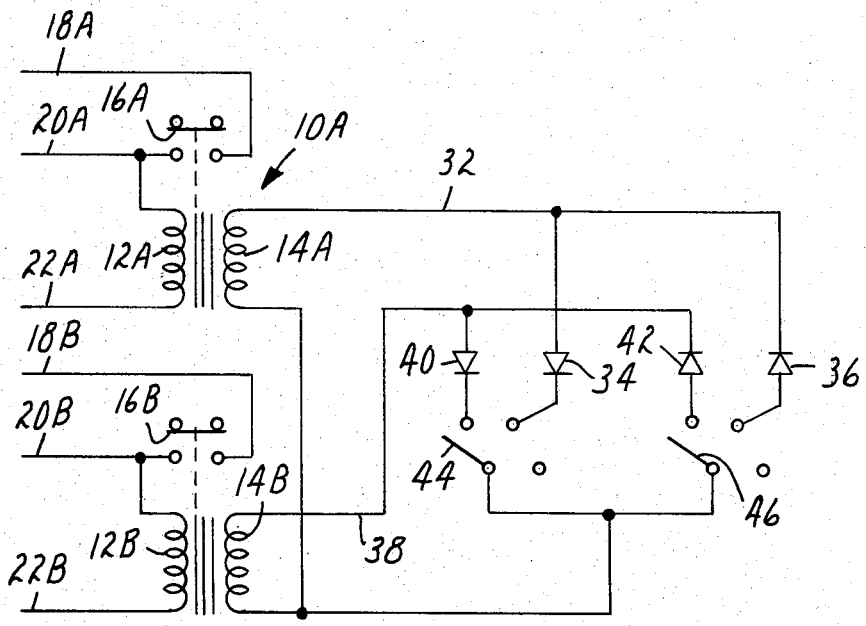
FIG. 3 illustrates the use of sequential energization of a plurality of transformer relays.

One means of eliminating the circulating current problem is to sequentially energize the secondary winding of each transformer relay. FIG. 3 illustrates one means of providing this function. Transformer relays 10A and 10B are similar to the transformer relays described in FIGS. 1 and 2. Each has a primary winding 12A and 12B connected to a power lead 20A and 20B and to a reference lead 22A and 22B. Also similarly, each have a load switch 16A and 16B connected to a load lead 18A and 18B. One side of secondary winding 14A of transformer relay 10A is connected to line 32 and to oppositely directed diodes 34 and 36. One side of secondary winding 14B of transformer relay 10B is connected to line 38 and to oppositely connected diodes 40 and 42. Diodes 34 and 40 are connected to switched terminals of sequential switch 44. Diodes 36 and 42 are connected to the switch terminals of sequential switch 46. The common terminals of sequential switches 44 and 46 are connected together and to the other side of secondary windings 14A and 14B. Sequential switch 44 is used to switch both transformer relays 10A and 10B in one direction, e.g. "on", by energizing secondary windings 14A and 14B sequentially. Similarly sequential switch 46 controls transformer relays 10A and 10B to the opposite state, e.g. "off", by energizing secondary windings 14A and 14B sequentially in the opposite direction. While the circuit illustrated in FIG. 3 solves the circulating current problem, note that three wires are needed to control two transformer relays with an additional wire needed for each additional transformer relay (above two) to be controlled. Also note that the sequential switches 44 and 46 are complex and must be sequentially energized. One separate switch is needed for the "on" operation and another for the "off" operation.

Figure 4:
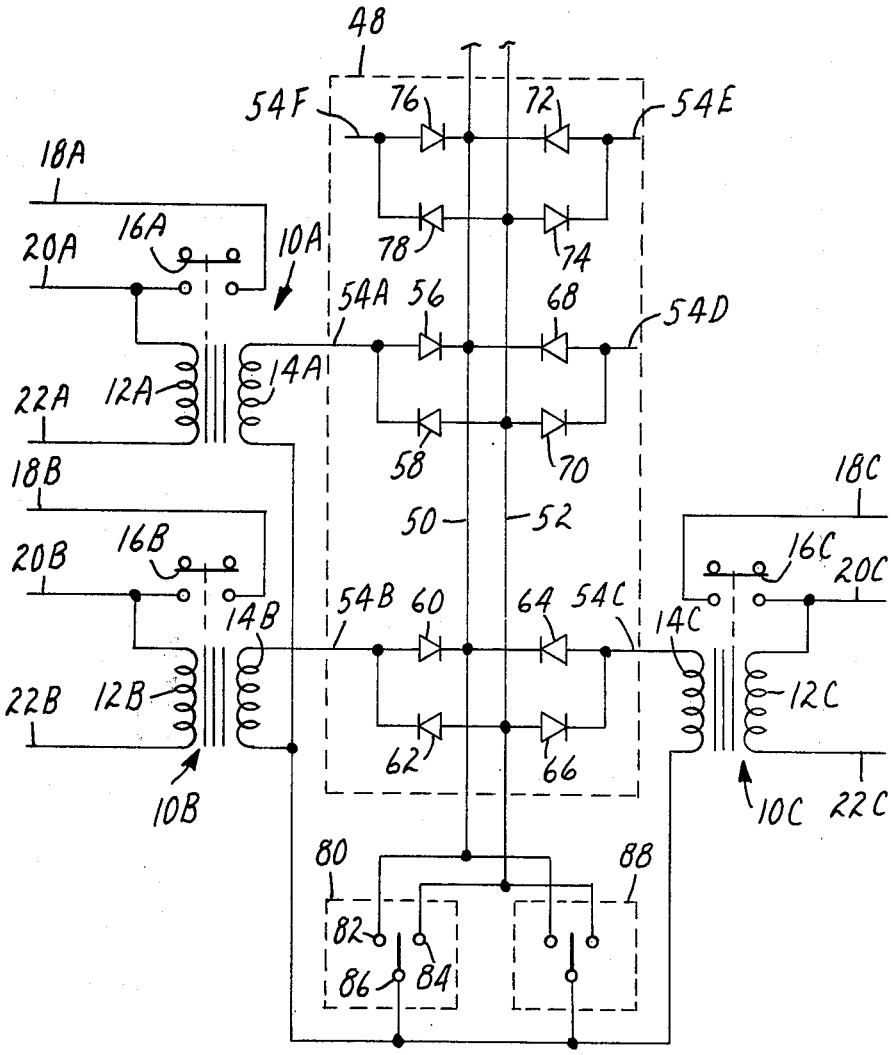
FIG. 4 illustrates a control system utilizing an electrical isolation network.

FIG. 4 illustrates a control system utilizing an electrical isolation network. Again a plurality of transformer relays 10A, 10B, and 10C are utilized. The primary windings 12A, 12B and 12C, the load switches 16A, 16B, and 16C, the load leads 18A, 18B, and 18C, the power leads 20A, 20B, and 20C, and the reference leads 22A, 22B, and 22C are connected as in FIGS. 1, 2 and 3. Again, the primary windings 12A, 12B, and 12C may be coupled to the same power source or may be connected to differing power sources. Control for the plural transformer relays 10A, 10B, and 10C is provided by coupling one side of secondary windings 14A, 14B, and 14C, to the electrical isolation network 48. The electrical isolation network 48 has a pair of common control lines 50 and 52. One side of secondary winding 14A of transformer relay 10A is coupled to the electrical isolation network 48 at point 54A. Similarly, one side of secondary winding 14B of transformer relay 10B is connected to the electrical isolation network 48 at point 54B. Still, similarly, one side of secondary winding 14C of transformer relay 10C is connected to the electrical isolation network 48 at point 54C. Diode 56 and diode 58 are coupled between point 54A and control lines 50 and 52, respectively. Diode 56 is oriented so that its anode is coupled to point 54A while diode 58 is oriented so that its cathode is coupled to point 54A. The cathode of diode 56 is coupled to common control line 50 while the anode of diode 58 is coupled to common control line 52. Diodes 60 and 62 are similarly connected to point 54B and common control lines 50 and 52 and diodes 64 and 66 are similarly coupled to point 54C and common control lines 50 and 52.

FIG. 4 is illustrated with three transformer relays 10A, 10B and 10C. The electrical isolation network 48 is illustrated with a capacity of coupling six separate transformer relays and illustrates the principal that not all coupling points need be utilized. Thus, as illustrated in FIG. 4, points 54D, 54E, and 54F could also be coupled to a secondary winding 14 of a transformer relay 10. Diodes 68 and 70 couple point 54D to common control lines 50 and 52 while diodes 72 and 74 couple point 54E to common control lines 50 and 52 and diodes 76 and 78 couple point 54F to common control lines 50 and 52 in the same manner. Further, common control lines 50 and 52 may be connected to similar common control lines and additional electrical isolation networks 48 to provide additional points 54 for the connection of transformer relays 10.

Common control lines 50 and 52 of the electrical isolation network 48 are then coupled to switch module 80. Switch module 80 is a single pole, double throw switch having two switched terminals 82 and 84, and a common terminal 86. The common control line 50 is coupled to switched terminal 82 and common control line 52 is coupled to switched terminal 84 of switch module 80. The second side of the secondary windings 14A, 14B, and 14C of transformer relays 10A, 10B, and 10C are all coupled together and to common terminal 86 of switch module 80. As is illustrated in FIG. 4, a plurality of switch modules may be coupled in parallel with common control lines 50 and 52 and with the second side of the secondary windings 14A, 14B, and 14C. This is illustrated in FIG. 4 by optional switch module 88.

While switch module 80 and optional switch module 88 are depicted in FIG. 4 as being single pole, double throw mechanical switches, it is understood that other switching units could be utilized in place of such a mechanical switch. Semiconductor switching means could also be utilized for this function. Essentially, switch module 80 and optional switch module 88 effectively selectively couple either common control line 50 or common control line 52 to the second side of the secondary windings 14A, 14B, and 14C of transformer relays 10A, 10B, and 10C.

It can be seen that the control system in FIG. 4, instead of coupling secondary windings 14A, 14B, and 14C in parallel, couples one side of secondary windings 14A, 14B, and 14C to the electrical isolation network 48. The second side of the secondary windings 14A, 14B, and 14C are coupled together in parallel. The electrical isolation network 48 allows the selective switching to occur in the secondary windings 14A, 14B and 14C while maintaining electrical isolation between the voltages instantaneously present on the transformer relays 10A, 10B, and 10C, and the secondary windings 14A, 14B, and 14C.

The particular electrical isolation network 48 illustrated in FIG. 4, in addition to providing the electrical isolation, also provides the directional control for the unidirectional current to be applied to the secondary windings 14A, 14B and 14C. This however, is not necessarily required. If the standard rectifying switch 24, as illustrated in FIG. 1 and 2, were utilized for switch module 80, the electrical isolation network 48 would only require electrical isolation. It is contemplated that other means of electrical isolation, perhaps also using a nonlinear solid state device, could be utilized. If other means of electrical isolation were utilized in the electrical isolation network 48, then the rectifying switch 24 of FIGS. 1 and 2 could be substituted for the switch module 80.

Note that although the electrical isolation network 48 has a capacity for six transformer relays at connection points 54A, 54B, 54C, 54D, 54E, and 54F, the arrangement of six connection points is arbitrary and other numbers and capacities could also be utilized and are contemplated.

It is also contemplated that additional electrical isolation networks 48 could be coupled in parallel with the existing electrical isolation network 48 by merely a parallel connection with common control lines 50 and 52. The parallel coupling of additional electrical isolation networks 48 would provide additional connection points 54 and would increase the capacity of the number of transformer relays which could be switched from a single switch module 80.

In the illustration in FIG. 4 the same side of all three secondary windings 14A, 14B, and 14C is coupled to connection points 54A, 54B, and 54C, respectively. If the transformer relay coils are all wound in a similar manner, this will result in all of the transformer relays 10A, 10B, and 10C, being controlled to the same state, e.g. "on". However, this need not necessarily be the case. All of the transformer relays 10A, 10B, and 10C need not be controlled to the same state upon the activation of a single common control line 50 or 52. By coupling the opposite side of one or more of the secondary windings 14A, 14B, and 14C, instead to connection points 54, then any individual transformer relay 10A, 10B, or 10C can be controlled to the opposite state, e.g. "off" while the remaining transformer relays are being controlled to the first state, e.g. "on".

It is significant to note that only two wire control is required between the electrical isolation network 48 and the switch module 80. Only a single wire connection is required between the transformer relays 10A, 10B, 10C, individually, and the electrical isolation network and only a single wire between the transformer relays 10A, 10B, 10C, individually, and the switch module 80.

A transformer relay 10 as contemplated to be controlled by the control system of the present invention can be the transformer relay as previously described in the Bollmeier patent and the Baker application. The transformer relay 10 is also contemplated to encompass the combination of a separate transformer and a distable or latching relay. The state of the bistable or latching relay may be determined by the direction of current flow in the relay windings as in the preferred embodiment above or may be determined by the selective energization of one of two relay windings (coils). The dual coil relay may, of course, be easily converted to a current direction sensitive relay by the addition of a current steering diode to each coil (winding). A plurality of relays may be coupled to one or more transformers and will provide the equivalent of a plurality of transformer relays 10. A first side of the secondary winding of the transformer may be coupled in parallel to a plurality of relays. The second side of the secondary winding of the transformer returns to the common terminal of the switch module 80. Similarly, a plurality of dual coil relays, possibly with current steering diodes, could be coupled to one or more transformer to also provide the equivalent of a plurality of transformer relays 10. Where a separate transformer and relay (single or multiple coil and single relay or a plurality of relays with a single transformer) performed the function of a transformer relay as defined herein, for purposes of definition of the claims the term "secondary winding" shall refer to the winding or coil or coils controlling the individual relay or relays.

Thus, it can be seen that there has been shown and described a novel control system. It is to be understood, however, that various changes, modifications, substitutions in the form and the details of the described control system can be made by those skilled in the art without departing from the scope of the invention as defined by the following claims.

What we claim is:

1. An electrical isolation network for controlling a plurality of transformer relays, each of said plurality of transformer relays having a primary winding adapted to be coupled to a source of power, having a secondary winding and having a plurality of states controllable from at least one switch adapted to be coupled to said secondary winding, comprising an array of nonlinear semiconductor devices selectively coupled to said secondary winding of each of said plurality of transformer relays and a pair of common control lines coupled to said at least one switch, with said nonlinear semiconductor devices and said common control lines providing electrical isolation for each of said transformer relays and providing the capability of controlling said plurality of transformer relays to an individually predetermined one of said plurality of states.

2. An electrical isolation network as in claim 1 wherein said array of nonlinear semiconductor devices is an array of diodes.

3. An electrical isolation network as in claim 2 wherein said array of nonlinear semiconductor devices comprises a first diode and a second diode, each having an anode and a cathode, associated with each of said plurality of transformer relays with said common control lines forming a first and second common control line, said anode of said first diode and said cathode of said second diode being coupled to a first side of said secondary winding of said associated one of said plurality of transformer relays, said cathode of said first diode being coupled to one of said pair of common control lines, said anode of said second diode being coupled to the other of said pair of common control lines, with said at least one switch being selectively coupled to said pair of common control lines.

4. A control system adapted to control a plurality of transformer relays, each of said plurality of transformer relays having a primary winding capable of being coupled to a source of power, having a secondary winding and having a plurality of states controllable from said secondary winding, comprising:

an electrical isolation means selectively coupled to said secondary winding of each of said plurality of transformer relays and having a pair of common control lines, said electrical isolation means for providing electrical isolation for each of said plurality of transformer relays and for providing the capability of controlling said plurality of transformer relays to an individually predetermined one of said plurality of states; and a switching means coupled to said common control lines of said electrical isolation means and coupled to said secondary winding of said plurality of transformer relays, said switching means for selecting to which of said plurality of states said plurality of transformer relays are controlled;

whereby all of said plurality of transformer relays can be controlled to a predetermined one of said plurality of states by said switching means with the maintenance of electrical isolation for each of said plurality of transformer relays.

5. A control system as in claim 4 wherein said electrical isolation means comprises an array of nonlinear semiconductor devices.

6. A control system as in claim 5 wherein said array of nonlinear semiconductor devices is an array of diodes.

7. A control system as in claim 4 wherein said switching means is a single pole, double throw switch.

8. A control system adapted to control a plurality of transformer relays, each of said plurality of transformer relays having a primary winding capable of being coupled to a source of power, having a secondary winding and having a pair of states controllable by a unidirectional current flow in said secondary winding, comprising:

an electrical isolation and control circuit having a first diode and a second diode, each having an anode and a cathode, associated with each of said plurality of transformer relays and having first and second common control lines, said anode of said first diode and said cathode of said second diode being coupled to a first side of said secondary winding of said associated one of said plurality of transformer relays, said cathode of said first diode being coupled to one of said pair of common control lines, said anode of said second diode being coupled to the other of said pair of common control lines; and a switch means having a common terminal and first and second switched terminals, said common terminal being coupled to a second side of said secondary winding of said plurality of said secondary winding of said plurality of transformer relays, said switched terminals being selectively coupled to said pair of common control lines, whereby all of said plurality of transformer relays can be controlled to an individually predetermined one of said plurality of states by said switching means with the maintenance of electrical isolation for each of said plurality of transformer relays.

9. A control system comprising:

a plurality of transformer relays, each having a primary winding adapted to be connected to a source of power and each having a secondary winding capable of controlling the state of said transformer relay;

an electrical isolation network coupled to said secondary winding of each of said plurality of transformer relays and having a pair of common control lines, said electrical isolation network providing for electrical isolation of said plurality of transformer relays; and a switch coupled to said common control lines of said electrical isolation network and to said secondary winding of each of said plurality of transformer relays, said switch selecting the state of each of said transformer relays;

whereby all of said plurality of transformer relays can be controlled by a predetermined state with the activation of said switch and with electrical isolation being maintained for each of said plurality of transfer relays.

* * * * *

UNITED STATES PATENT AND TRADEMARK OFFICE

CERTIFICATE OF CORRECTION

PATENT NO. : 4,384,314

DATED : May 17, 1983

INVENTOR(S) : Charles T. Doty and Douglas R. Mosier

It is certified that error appears in the above—identified patent and that said Letters Patent is hereby corrected as shown below:

Col. 7, line 6, change "distable" to -- bistable --.

Col. 10, line 9, change "by" to -- to --.

Signed and Sealed this

*Sixteenth* Day of *August 1983*

[SEAL]

*Attest:*

GERALD J. MOSSINGHOFF

*Attesting Officer*

*Commissioner of Patents and Trademarks*